US006148160A

United States Patent [19]

Maess et al.

[11] Patent Number: 6,148,160

[45] Date of Patent: Nov. 14, 2000

[54] DEVELOPER APPARATUS HAVING MASS SENSOR FOR AN ELECTROGRAPHIC PRINTER OR COPIER

[75] Inventors: Vokhard Maess, Erding; Martin Schleusener, Zorneding; Reinhard Apel, Vaterstetten, all of Germany

[73] Assignee: Oce Printing Systems GmbH, Poing, Germany

[21] Appl. No.: 09/331,299

[22] PCT Filed: Dec. 17, 1997

[86] PCT No.: PCT/DE97/02958

§ 371 Date: Aug. 12, 1999

§ 102(e) Date: Aug. 12, 1999

[87] PCT Pub. No.: WO98/27468

PCT Pub. Date: Jun. 25, 1998

[30] Foreign Application Priority Data

Dec. 18, 1996 [DE] Germany ..... 196 52 863

[51] Int. Cl.[7] ..... G03G 15/08

[52] U.S. Cl. ..... 399/53; 399/58

[58] Field of Search ..... 399/53, 55, 58, 399/61, 62, 63, 119, 265, 266, 279, 274, 284

[56] References Cited

U.S. PATENT DOCUMENTS

| | | |
|---|---|---|
| 4,026,643 | 5/1977 | Bergman . |
| 4,777,106 | 10/1988 | Fotland et al. . |
| 5,006,897 | 4/1991 | Rimai et al. . |
| 5,235,385 | 8/1993 | Rushing . |
| 5,285,243 | 2/1994 | Rimai et al. . |

FOREIGN PATENT DOCUMENTS

| | | |
|---|---|---|
| 0 494 454 | 7/1992 | European Pat. Off. . |
| 29 30 785 | 2/1983 | Germany . |
| 4-142573 | 5/1992 | Japan . |

*Primary Examiner*—Quana M. Grainger
*Attorney, Agent, or Firm*—Hill & Simpson

[57] ABSTRACT

A developer unit for an electrographic printer or copier has a toner receiving surface designed to receive a coating of toner particles. A toner mass sensor and a toner charge sensor measure a coting of toner particles on the toner receiving surface and send signals to an evaluation unit which calculates a mass-referred toner charge.

12 Claims, 4 Drawing Sheets

DEVELOPER APPARATUS HAVING MASS SENSOR FOR AN ELECTROGRAPHIC PRINTER OR COPIER

BACKGROUND OF THE INVENTION

1. Field of the Invention

The invention is directed to a developer unit for an electrographic printer or copier with a toner acceptance surface accepting a layer containing toner particles, referred to in brief as toner layer.

2. Description of the Related Art

The structure of such a developer unit with a developer drum as toner acceptance surface is set forth in U.S. Pat. No. 4,777,106. For this developer unit, containing a toner reservoir where a toner-air mixture is located, and where toner particles are electrically charged and are subsequently deposited on the toner acceptance surface. This surface is either grounded or provided with a potential, and the charged toner particles are deposited thereon as a toner layer under the influence of an electrical force field. Due to the rotation of a developer drum whose generated surface forms the toner acceptance surface, the deposited toner particles are conducted past a development gap between the developer drum and a toner image carrier. The toner image carrier carries a latent charge image onto which toner particles are selectively applied at the development gap, creating a toner image. The toner image is then applied onto an ultimate image carrier, for example onto paper, from the toner image carrier with or without employing an intermediate image carrier.

A developer belt can also be used in place of the developer drum. A developer unit having more than one toner acceptance surface is explained in European Patent EP 0 494 454. The second toner acceptance surface is formed by the generated surface of a transfer drum on which the toner particles are applied directly from the reservoir. The toner particles are then deposited onto the surface of the developer drum at a transfer gap between the transfer drum and the developer drum.

The known developer units do not allow monitoring of the developing process and, in particular, of the amount of toner output by the developer unit. When the toner amount per surface on the toner acceptance surface or the charge amount per surface in the toner layer during developing lies outside of a predetermined range the error is not recognized until the finished print image is produced, resulting in a delayed corrective response. The disturbances in the print image are particularly noticeable for large-area picture elements.

Both dry and liquid toners can be used. The toners that are employed can also be divided into single-component and multi-component toners. Electrographic printers encompass electrophotographic printers, ionographic printers and magnetographic printers.

U.S. Pat. No. 5,006,897 or, respectively, U.S. Pat. No. 4,026,643 disclose developer units wherein the properties of a toner particle developer layer forming a magnetic brush are acquired with the assistance of a potential sensor and a capacitative circuit or, alternately an optical sensor.

SUMMARY OF THE INVENTION

An object of the invention is to specify a simply constructed developer unit that enables developing with high quality.

This object is achieved by an apparatus comprising a developer unit having a toner acceptance surface that accepts a layer of toner particles wherein a capacitive sensor acquires toner mass from a toner layer thickness on the toner acceptance surface (or alternately, a radiation source and sensor, particularly where the toner layer is thin), a potential sensor acquires an electrical potential over the toner layer on the toner acceptance surface, and an evaluation unit that calculates the mass-referred toner charge from the identified toner mass and the potential. This objective may further be achieved by utilizing controllers which control the average toner mass and average toner charge, and a system that is able to store various characteristic curves.

The invention is based on the principle that characteristic quantities that critically define the quality of the developing process and, thus, critically define the quality of the print image as well must be acquired in the developer unit prior to the developing process termination in order to allow a quick reaction to deviations of these characteristic quantities from rated values. This results in avoiding low quality print images as well as increased paper and energy consumption.

A developer unit containing a radiation source for irradiating at least one surface section of the layer and a radiation sensor for acquiring the amount of radiation remitted or transmitted from the surface section, allows, for example, the following characteristic quantities of the development process to be determined via the optical properties of the toner layer: average thickness of the layer, toner mass per surface section or toner mass on the entire toner acceptance surface. Per surface section means that a relatively uniform layer is assumed and that the toner mass acquired refers to a defined surface section of the toner layer of, for example, 1 $cm^2$. The total area of the toner layer is used as reference quantity.

When the toner acceptance surface is made of a material that is opaque to the radiation from the radiation source, then the radiation sensor is arranged such that it acquires radiation remitted or, respectively, reflected from the surface section. When, by contrast, the toner acceptance surface is made of a material transparent to the radiation from the radiation source, then, alternatively, the toner acceptance surface can be arranged between radiation source and radiation sensor so that the radiation sensor acquires a transmitted amount of radiation.

Visible light, ultraviolet radiation or infrared radiation can, for example, be employed as radiation. The wavelength of the radiation is adapted to the absorption or remission properties of the toner layer. The goal is thereby to select the wavelength such that, depending on the thickness of the toner layer, an optimally large signal difference results at the output of the radiation sensor, for even small modifications of the layer thickness.

The acquisition of the layer thickness or, respectively, calculated quantities derived from the radiation sensor, input, provide high measuring precision, particularly given small layer thickness differences.

When a capacitative sensor for acquiring the capacitance between the measuring electrodes is arranged in the developer unit, then the aforementioned characteristic quantities of the layer can be acquired when at least one surface section of the toner acceptance surface forms the first measuring electrode and the second measuring electrode is arranged at a predetermined distance from the first measuring electrode so that the toner layer proceeds between the two measuring electrodes in the fashion of a dielectric. The thickness of the dielectric or, respectively, of the toner layer, influences the capacitance according to known principles. The acquisition of toner layer properties with the capacitative sensor has the advantage that the measuring range is not upwardly limited since, even for relatively thick layers, an increase in the layer thickness still leads to a detectable change of the capacitance.

When a potential sensor for acquiring the electrical potential of at least one surface section of the toner layer is arranged in the developer unit close to the toner acceptance surface, then the charge per surface section or, respectively, the average toner charge per surface section on the toner acceptance surface can be acquired. Gross disturbances of the developing process can be recognized from this characteristic quantity.

All of said sensors work in a non-contacting manner, so that the uniformity of the toner layer is not deteriorated when acquiring its properties.

The evaluation units for said sensors can be realized in circuit-oriented terms or in software terms. Simple evaluation units can be employed that compare the sensor output signal to a predetermined threshold and, given an inadmissible sensor output signal, output a signal that, for example, leads to the interruption of the printing process or is output in a fashion perceptible to an operator, such as an optical or acoustic signal. Control units can also be utilized that derive manipulated variables for influencing the development process from the output signals.

According to the invention, the developer unit contains a combination of said sensors. Sensors of one type can be utilized at different surface sections of the layer in order to compensate statistical fluctuations of the acquired layer property. Sensors of different types can be utilized in order to compensate the disadvantages of the one sensor type with the advantages of the other sensor type. Thus, for example, if the radiation sensor is employed in a lower through middle region of the layer thickness the capacitative sensor might then be employed in the middle through upper regions. As a result of this combination, the thickness of the toner layer can be measured with high precision over the entire thickness region.

When the evaluation unit combines the output signals of the radiation sensor and/or of the capacitative sensor as well as the output signal of the potential sensor to form a signal that is a criterion for the average mass-related toner charge, then one of the most critical characteristic quantities of the developing process can be acquired and offered for further processing.

When a controller uses the acquired layer thickness the layer thickness can be adjusted to a predetermined rated value. The resulting uniform layer thickness leads to a higher-quality print image than known methods produce. The charge of the toner particles is controlled in a further controller proceeding from the output signal of the potential sensor. As a result of the simultaneous control of the layer thickness and the charge of the toner particles, the mass-referred toner charge can be kept substantially constant during the entire developing process. This leads to a uniform deposit of the toner particles on the latent charge image and, ultimately, leads to a high-quality print image.

A controller can also be employed for controlling the charge of the toner particles that processes the output signal of the radiation sensor and/or the output signal of the capacitative sensor as well as the output signal of the potential sensor. In contrast to the aforementioned control whereby the characteristic quantities of the development process are utilized in separate controllers, for example, controllers that are coupled to one another in a cascading manner a control of the characteristic quantities can be achieved with a single controller leading to optimum control of the development process due to a uniform control strategy in the controller.

In a further exemplary embodiment of the invention, a system for storing the curve of the respective sensor characteristic is employed when processing the sensor signals, this system indicating the relationship between the respectively acquired sensor characteristic and the sensor output signal. This characteristic is determined in a calibration procedure where sensor output signals for layers are measured when the characteristic quantity to be respectively acquired has a known value. This characteristic is deposited in a storage system, such as a digital memory or a function network. The digital memory is a component part of a processor unit for controlling the developer unit or for controlling the entire printer. This allows the non-linearities of the sensors to have no influence in further processing, which allows the application of linear control technology principles.

In order to prevent a deterioration of the measuring precision of the sensors due to deposits of toner particles or dust, the sensor, for example, can be surrounded by an air stream that effectively prevents deposits.

DESCRIPTION OF THE PREFERRED EMBODIMENT

Figure 1:
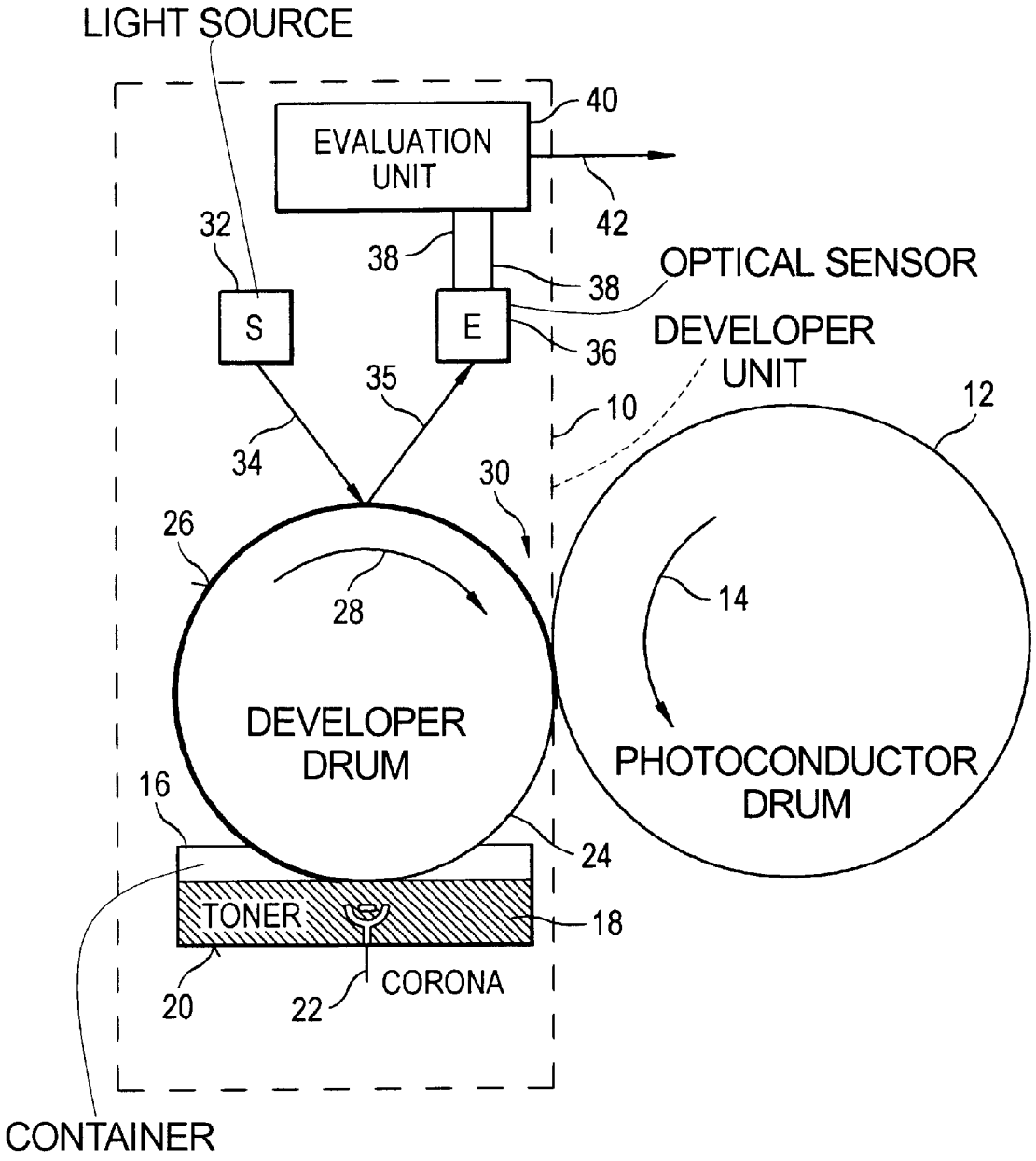
FIG. 1 is a schematic illustration of a developer unit with an optical sensor for acquiring the toner mass per surface section on the developer drum.

FIG. 1 schematically shows the structure of a developer unit 10 that is arranged close to a photoconductor drum 12, whereby the photoconductor drum 12 rotates in the direction of an arrow 14 driven by a driver (not shown). A latent charge image that was applied by an illumination unit (not shown) is located on the surface of the photoconductor drum 12 in the surface region facing toward the developer unit 10. The charges are distributed in the latent charge image according to the image information of the image to be printed.

The developer unit 10 contains a container 16 in which a toner-air mixture 18 is located. Toner particles and air are mixed in roughly the ratio 1:10 in the mixture 18, resulting in the mixture 18 behaving like a liquid. The mixture 18 is thereby generated from solid toner particles having an average size of approximately 10 $\mu$m and air that flows via a large-area into the container 16 through an air-permeable bottom plate 20 of the container 16.

A corona device 22 is arranged in the toner-air mixture 18, a voltage of approximately −8 kV being adjacent thereto, so that toner particles of the mixture 18 are negatively charged in the environment of the corona device 22. The corona device 22 proceeds transversely through the entire developer unit 10 over a length that approximately corresponds to the length of the photoconductor drum 12 transversely relative to the rotational direction 14. A developer drum 24 whose axis proceeds parallel to the corona device 22 is arranged above the corona device 22. An electrically conductive surface layer of the developer drum 24 has a potential of approximately −0.6 kV, so that the negatively charged toner particles—due to the influence of the electrical field between the corona device 22 and the developer drum 24—are deposited on the surface of the developer drum 24 over the entire length of the corona device 22.

The surface of the developer drum 24 is located at a defined distance from the corona device 22, so that a uniform toner layer 26 arises on the surface of the developer drum 24. The developer drum 24 is turned around its axis in the direction of an arrow 28 by a drive mechanism (not shown). During rotation, the toner layer 26 is transported on the circumference of the developer drum 24 until it reaches a development gap 30 that is formed by the surface of the photoconductor drum 12 and the surface of the developer drum 24, whereby both surfaces, for example, move synchronously. The development gap 30 has a constant width over the entire length in the direction of the axis of the developer drum 24. The latent charge image of the photoconductor drum 12 is developed in the development gap 30 in that toner particles of the toner layer 26 deposit in discharged areas of the surface of the photoconductor drum 12 by jumping over the development gap. Toner particles remaining on the developer drum 24 are removed from the surface layer of the developer drum 24 by a stripper (not shown) before new toner particles are again applied in the region of the corona device 22.

The toner image applied onto the photoconductor drum 12 is transferred onto paper in a transfer printing station (not shown) and is fixed in a fixing station.

A light source 32 that irradiates a surface section of the toner layer 26 is arranged in the developer unit 10 (see arrow 34). The amount of beamed-in light that is reflected by the layer 26 depends on the thickness of the layer 26. A part of the reflected light (see arrow 35) is acquired by an optical sensor, for example a photodiode or a photoresistor. Two output lines 38 of the optical sensor 36 are connected to an evaluation unit 40 that generates a signal on a line 42 whose value is proportional to the thickness of the toner layer 26. The further processing of the signal on the line 42 is presented below with reference to FIGS. 4 and 5.

Figure 2:
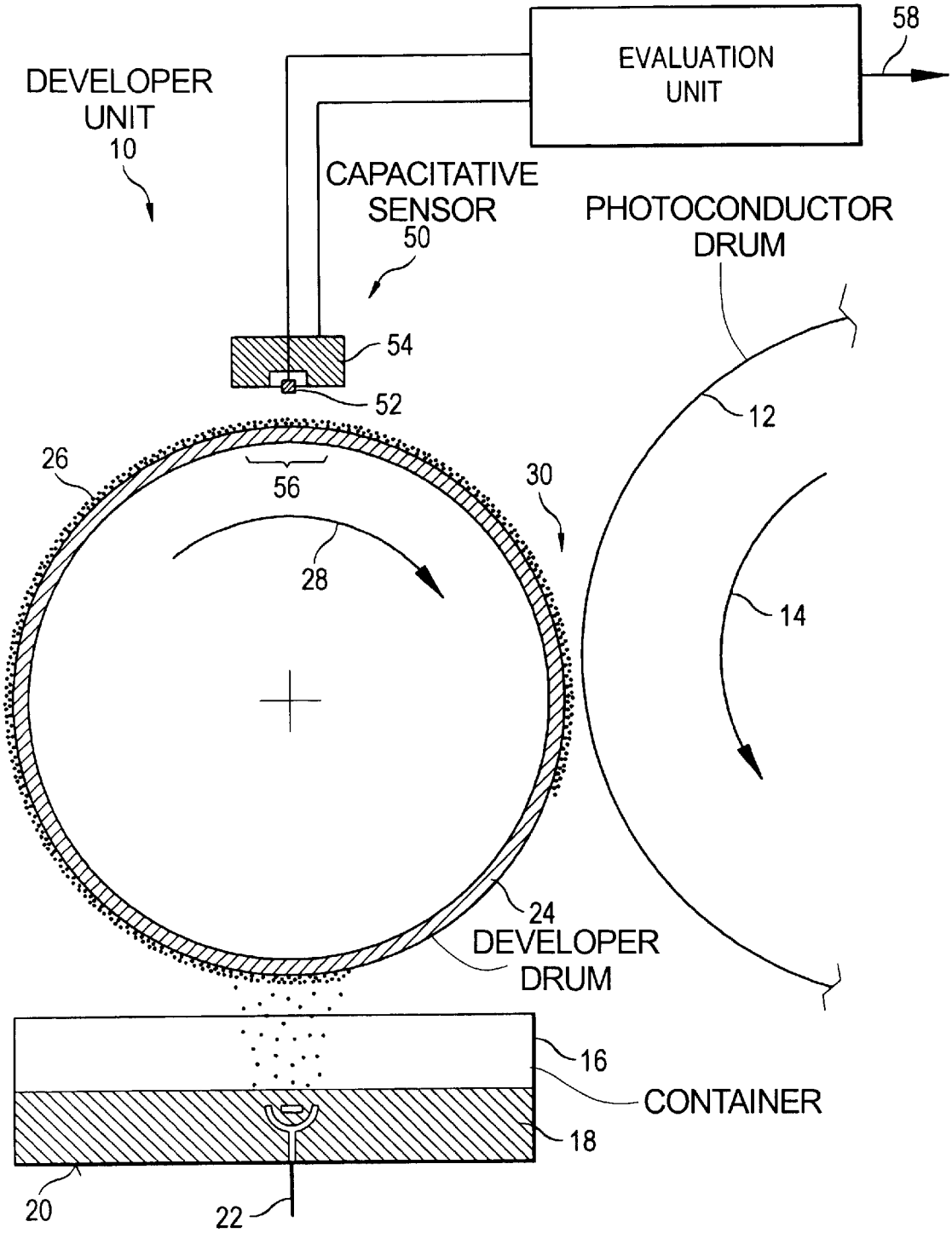
FIG. 2 is a schematic diagram showing an arrangement of a capacitative sensor for acquiring the toner mass per surface section at the developer drum.

FIG. 2 shows the arrangement of a capacitative sensor 50 at the developer drum 24. The capacitative sensor 50 can be employed instead of or in addition to the optical sensor 36 (see FIG. 1) for determining the thickness of the toner layer 26.

The capacitative sensor 50 contains an electrode 52 that is surrounded by a shielding 54. The cooperating electrode of the sensor 50 is formed by a surface section 56 of the surface of the developer drum 24 that lies directly opposite the sensor 50. The capacitance between the electrode 50 and the cooperating electrode 56 changes dependent on the thickness of the layer 26. The electrodes 52 and 56 are connected to an evaluation unit 58 at whose output line 58 a signal is generated whose value is proportional to the thickness of the layer 26. The processing of the signal on the output line 58 is likewise explained below on the basis of FIGS. 4 and 5.

Figure 3:
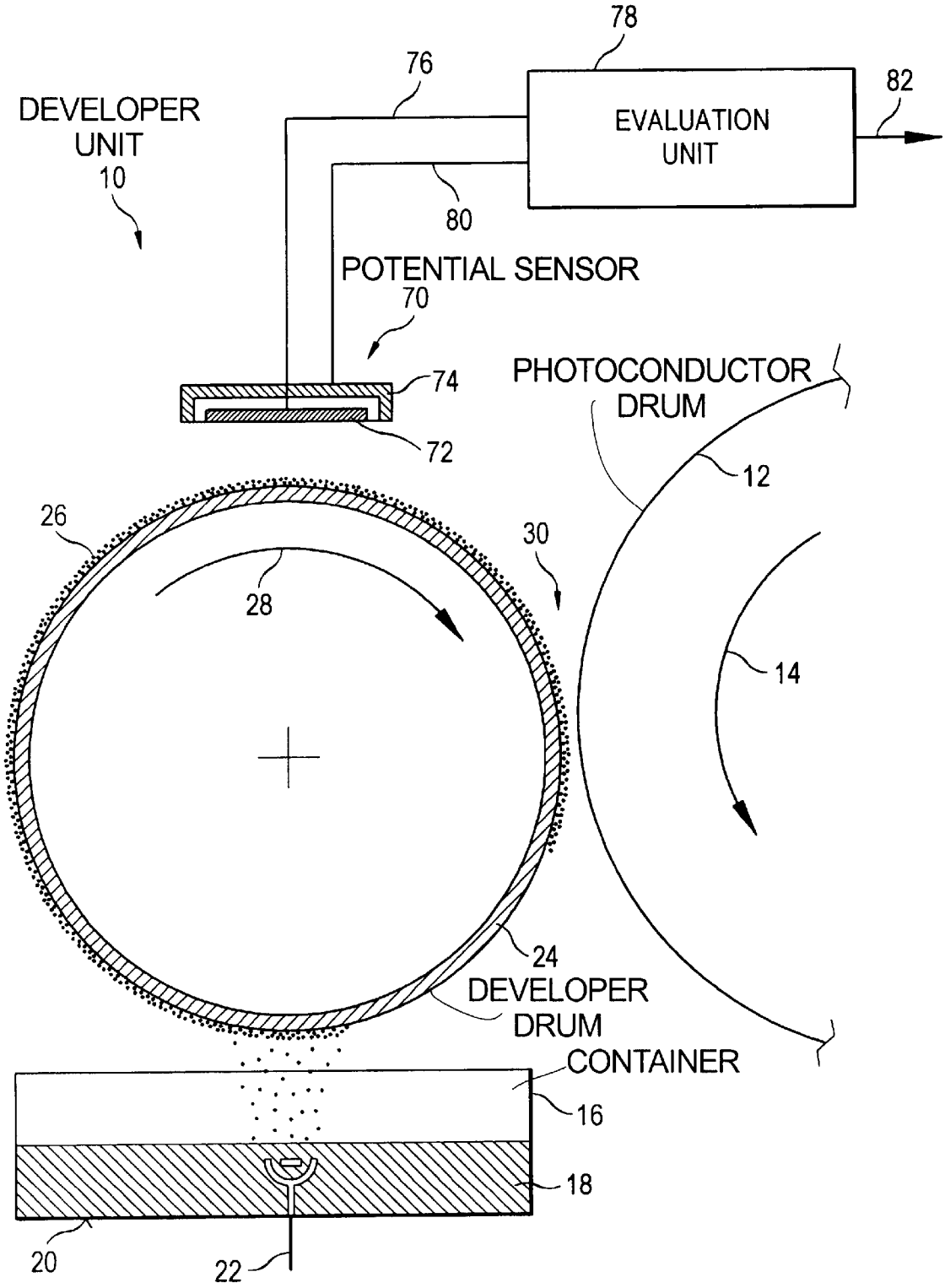
FIG. 3 is a schematic diagram showing an arrangement of a potential sensor for acquiring the charge quantity.

FIG. 3 shows the arrangement of a potential sensor 70 in the developer unit. The potential sensor 70 can be arranged in the developer unit 10 as a discrete sensor or in combination with the optical sensor 36 (see FIG. 1) and/or the capacitative sensor 50 (see FIG. 2).

The potential sensor 70 contains an electrode 72 and a shielding 74 for shielding external electrical fields. The electrode 72 is connected to an evaluation unit 78 via a line 76. The shielding is also connected via a line 76 to the evaluation unit 78. A potential is influenced at the electrode 72, with this potential being determined by the potential of the developer drum 24 and by the totality of the toner charge that is located in the field region of the electrode 72 on the surface of the developer drum 24. The evaluation unit 78 acquires this potential, which is converted into a signal on an output line 82 modified by a characteristic curve. The potential sensor is flooded by an air stream from a blower (not shown), so that a deposit of dust and toner particles at the potential sensor 70 does not arise and the measuring precision of the potential sensor 70 remains constant. The further processing of the setting signal is explained below with reference to FIGS. 4 and 5.

Figure 4:
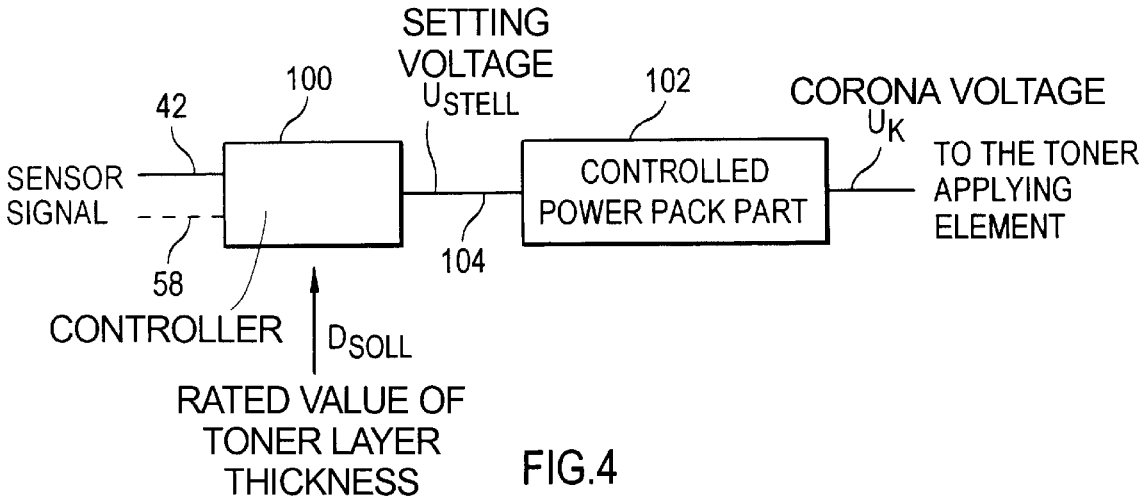
FIG. 4 is a block diagram showing a control of the toner mass per surface section.

FIG. 4 shows the schematic illustration of a control of the toner layer thickness. The line 42 at the output of the evaluation unit 40 of the optical sensor 36 (see FIG. 1) has its input side connected to a controller 100. Before the beginning of the developing process, the controller 100 is provided with a rated value DSOLL for the thickness of the toner layer. The controller compares the rated value DSOLL to the actual value DIST of the thickness of the toner layer signaled on the line 42, generating an error signal.

The controller 100 generates a setting voltage USTELL based on the error signal that is supplied to a controlled power pack part 102 via a line 104. The controlled power pack part 102 generates a voltage UK for the corona device 22 (see FIG. 1) based on the size of the setting voltage USTELL The voltage USTELL is determined by the controller 100 such that the error signal is reduced in amount and ultimately assumes the numerical value of "0". In this case, the actual thickness of the toner layer coincides with the rated thickness. Renewed control events occur when disturbances change the thickness of the toner layer. In the example of FIG. 4, a PI regulator is employed as controller 100.

When the controller 100 is connected to the output line, then the signal on the output line 42 or on the output line 58 can be optionally employed for controlling the layer thickness. The signals of both the optical sensor 36 and the capacitive sensor 50 are evaluated against a predetermined value related to layer thickness.

Figure 5:
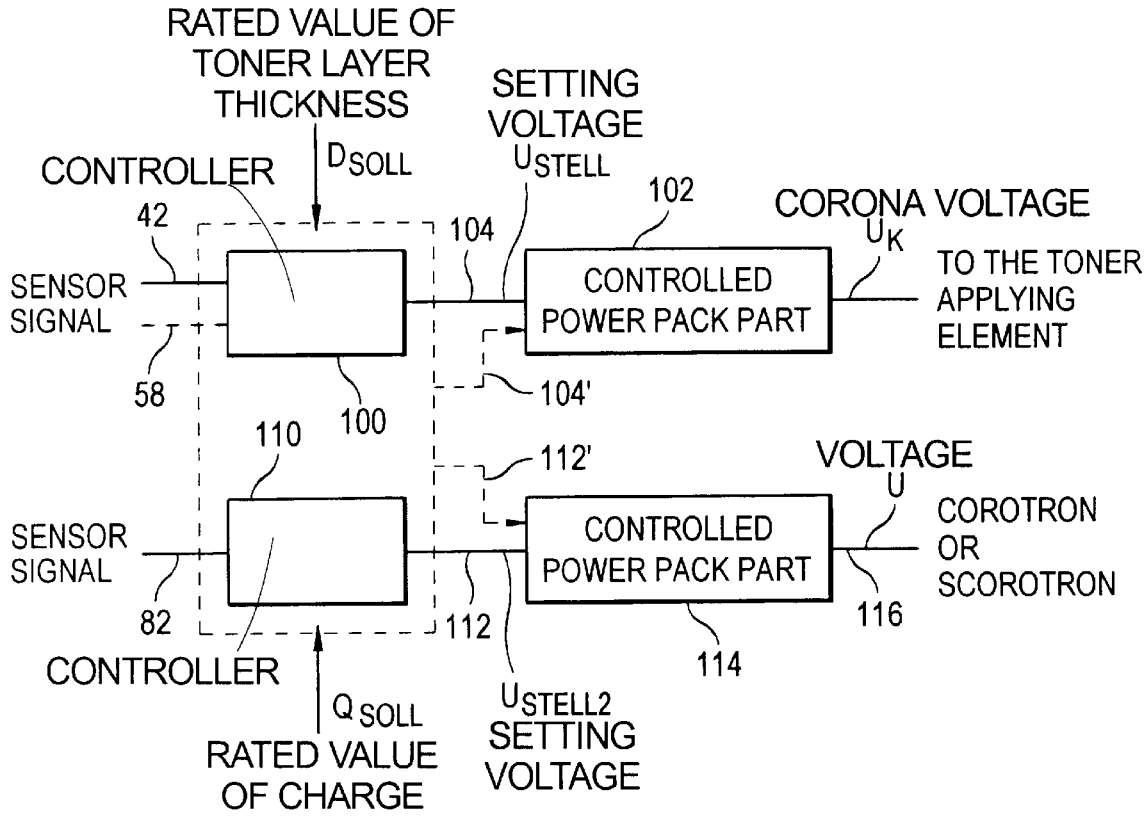
FIG. 5 is a block diagram showing a control of the mass-referred toner charge.

FIG. 5 shows a schematic illustration of a control of the mass-referred toner charge. In addition to the control circuit with the controller described with reference to FIG. 4, FIG. 5 shows a second control circuit that regulates the charge of the toner particles to a predetermined, rated charge value QSOLL with the assistance of a corotron or scorotron influencing the layer 26 (see FIG. 1). The second control circuit contains a controller 110 that is connected to the output line 82. The controller 110 generates a setting voltage USTELL2 on a line 112 for driving a controlled power pack part 114. The setting voltage USTELL2 is determined by the controller 110 such that an error signal between a predetermined rated value for the charge on a surface section of the toner layer and the actual value acquired by the potential sensor 70 is reduced in amount until is reaches the numerical value of "0". The controlled power pack part 114 generates a voltage U that is applied to the corotron via a line 116.

In a further exemplary embodiment, the control units 100 and 110 are combined to form one control unit 120 that contains a microprocessor and a main memory in which a control program is stored. Dependent on the signals on the lines 42, 58 and 82, the power pack part 102 is driven via a line 104' and the power pack part 114 is driven via a line 112' such that the mass-referred toner charge qT at the development gap 30 (see, for example, FIG. 1) has a constant, predetermined value. The mass-referred toner charge qT is calculated according to the following equation.

$$qT = \frac{QT}{MT}$$

whereby QT is the toner charge per surface section acquired by the potential sensor 70 according to FIG. 3 and MT is the toner mass per surface section, or simply, the surface mass. A surface section of the toner layer having a predetermined size is employed as reference surface element for the toner charge and the toner mass.

List of Reference Characters

10 developer unit
12 photoconductor drum
14 directional arrow
16 container
18 toner-air mixture
20 air-permeable bottom plate
22 corona means
24 developer drum
26 toner layer
28 rotational sense
30 development gap
32 light source
34 arrow
36 optical sensor
38 output line
40 evaluation unit
42 line
50 capacitative sensor
52 electrode
54 shielding
56 cooperating electrode
58 output line
70 potential sensor
72 electrode
74 shielding
76 line
78 evaluation unit
80 line
82 output line
100 control means
102 controlled power pack part
104 line
110 control means
112 line
114 controlled power pack part
116 line
120 control means
DSOLL rated value of the thickness
DIST actual value of the thickness
USTELL setting voltage
UK corona voltage
USTELL2 setting voltage
U voltage
qT average toner particle charge
QT surface charge
MT surface mass

What is claimed is:

1. A developer apparatus for use in an electrographic image transfer unit having a photoconductor with a latent charge image thereon, said developer apparatus comprising:

a toner acceptance surface having a toner layer thereon, said toner layer having a layer thickness, a toner mass, a toner potential and a toner charge, said toner acceptance surface being spaced by a gap from said photoconductor and transporting said toner layer through said gap for depositing toner from said toner layer on said latent charge image;

a capacitive mass sensor which identifies said toner mass by measuring said layer thickness, said capacitive mass sensor having a first electrode comprising at least a portion of said acceptance surface and a second electrode spaced from said acceptance surface, with said toner layer disposed between said first and second electrodes;

a potential sensor which measures said toner potential; and an evaluation unit supplied with said toner mass from said capacitive mass sensor and said toner potential from said potential sensor for calculating said toner charge from said toner mass and said toner potential.

2. A developer apparatus according to claim 1, wherein said mass sensor further comprises a radiation-mass sensor, said radiation-mass sensor comprising:

a radiation source for the irradiation of at least one surface section of said toner layer;

a radiation sensor for acquiring the amount of radiation remitted or transmitted from said surface section; and said developer unit further comprising an evaluation unit for evaluating an output signal of said radiation sensor.

3. A developer apparatus according to claim 2, wherein said developer apparatus further comprises an evaluation unit that evaluates at least one output signal selected from the group consisting of either said output signal of said radiation sensor or an output signal of said capacitive sensor.

4. A developer apparatus according to claim 1, wherein said toner particles jump across said development gap.

5. A developer apparatus according to claim 1, further comprising a toner mass controller for controlling said average toner mass per surface section, wherein said toner mass controller processes one of a plurality of output signals of said mass sensor.

6. A developer apparatus according to claim 5, further comprising a toner charge controller for controlling the average toner charge per surface section, wherein said toner charge controller processes said output signal of said potential sensor.

7. A developer apparatus according to claim 6, wherein a toner mass-charge controller encompasses the functionality of both said toner mass controller and said toner charge controller.

8. A developer apparatus according to claim 1, further comprising at least one system for storing a curve of a characteristic that indicates the relationship between a characteristic quantity influencing a developing process and one of a plurality of sensor output signals.

9. A developer apparatus according to claim 1, further comprising a cleaning system for preventing deposits on one of said sensors.

10. A developer apparatus according to claim 9, wherein said cleaning system generates an air stream at said sensors.

11. A developer apparatus according to claim 1, wherein said toner particles are taken from a toner-air mixture that behaves like a liquid.

12. A developer apparatus according to claim 1, further comprising a toner charge controller for controlling the average toner charge per surface section, wherein said toner charge controller processes an output signal of said potential sensor.

* * * * *